US010312586B2

(12) United States Patent
Weiler et al.

(10) Patent No.: US 10,312,586 B2
(45) Date of Patent: Jun. 4, 2019

(54) INTEGRATED TRANSCEIVER WITH FOCUSING ANTENNA

(71) Applicant: Fraunhofer-Gesellschaft zur Foerderung der angewandten Forschung e.V., Munich (DE)

(72) Inventors: Richard Weiler, Berlin (DE); Wilhelm Keusgen, Berlin (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/684,599

(22) Filed: Aug. 23, 2017

(65) Prior Publication Data

US 2017/0352952 A1 Dec. 7, 2017

Related U.S. Application Data

(63) Continuation of application No. PCT/EP2015/053817, filed on Feb. 24, 2015.

(51) Int. Cl.

| | |
|---|---|
| ***H01Q 1/24*** | (2006.01) |
| ***H01Q 3/18*** | (2006.01) |
| ***H01Q 1/22*** | (2006.01) |
| ***H01Q 3/16*** | (2006.01) |
| ***H01Q 3/24*** | (2006.01) |
| ***H01Q 3/46*** | (2006.01) |
| ***H01Q 15/14*** | (2006.01) |
| ***H01Q 19/10*** | (2006.01) |
| ***H01Q 1/12*** | (2006.01) |
| ***H01Q 1/42*** | (2006.01) |

(52) U.S. Cl.

CPC ..... *H01Q 3/18* (2013.01); *H01Q 1/125* (2013.01); *H01Q 1/2283* (2013.01); *H01Q 1/42* (2013.01); *H01Q 3/16* (2013.01); *H01Q 3/245* (2013.01); *H01Q 3/46* (2013.01); *H01Q 15/14* (2013.01); *H01Q 19/10* (2013.01); *H01Q 19/104* (2013.01)

(58) Field of Classification Search

CPC ..... H01Q 3/18
USPC ..... 343/702
See application file for complete search history.

(56) References Cited

U.S. PATENT DOCUMENTS

| | | | |
|---|---|---|---|
| 5,091,733 | A | 2/1992 | Labruyere |
| 5,283,591 | A | 2/1994 | Delmas |
| 6,424,314 | B1 | 7/2002 | Baghdasarian et al. |

(Continued)

FOREIGN PATENT DOCUMENTS

| | | | |
|---|---|---|---|
| CN | 102239599 | A | 11/2011 |
| CN | 102723582 | A | 10/2012 |

(Continued)

OTHER PUBLICATIONS

Serbe, Peter et al., "Sencity (Trademark) Link 60—A Wireless Point-To-Point Transparent Ethernet Bridge", Huber + Suhner, 2007, 1-6.

*Primary Examiner* — Peguy Jean Pierre
(74) *Attorney, Agent, or Firm* — Perkins Coie LLP; Michael A. Glenn

(57) ABSTRACT

An apparatus includes a fully integrated self-contained radio device including an antenna and an antenna element. The radio device and the antenna element are arranged such that a radio signal emitted by the antenna of the radio device is amplified in at least one predefined spatial direction.

10 Claims, 4 Drawing Sheets

(56) References Cited

U.S. PATENT DOCUMENTS

| | | | | |
|---|---|---|---|---|
| 8,493,279 | B2 * | 7/2013 | Pera | H01Q 19/191 343/833 |
| 9,879,990 | B2 * | 1/2018 | Klepsvik | G01S 17/42 |
| 2004/0263408 | A1 | 12/2004 | Sievenpiper et al. | |
| 2010/0103073 | A1 | 4/2010 | Texier et al. | |
| 2011/0037678 | A1 | 2/2011 | Tang et al. | |
| 2013/0271337 | A1 | 10/2013 | Huerta et al. | |
| 2015/0022414 | A1 | 1/2015 | Maruyama et al. | |
| 2016/0329631 | A1 * | 11/2016 | Rheinfelder | H01Q 1/246 |

FOREIGN PATENT DOCUMENTS

| | | | |
|---|---|---|---|
| CN | 103384030 | A | 11/2013 |
| EP | 2822097 | A1 | 1/2015 |
| GB | 2278020 | A | 11/1994 |
| JP | H02295301 | A | 12/1990 |
| JP | H05308221 | A | 11/1993 |
| JP | H07226622 | A | 8/1995 |
| JP | H11355036 | A | 12/1999 |
| JP | 2002185243 | A | 6/2002 |
| JP | 2002185243 | A1 | 6/2002 |
| JP | 2004180246 | A | 6/2004 |
| WO | 2009017106 | A1 | 2/2009 |
| WO | 2010141548 | A2 | 12/2010 |
| WO | 2014071866 | A1 | 5/2014 |

* cited by examiner

INTEGRATED TRANSCEIVER WITH FOCUSING ANTENNA

CROSS-REFERENCE TO RELATED APPLICATIONS

This application is a continuation of copending International Application No. PCT/EP2015/053817, filed Feb. 24, 2015, which is incorporated herein by reference in its entirety.

The present invention relates to wireless communication systems, more specifically to wireless transceivers.

BACKGROUND OF THE INVENTION

Conventional wireless transceivers, like fully integrated self-contained wireless transceivers, are known in the art and are provided and designed for a short range communication. The problem with this kind of transceivers is that due to the short range communication they cannot provide for a simple extension of the link, rather, additional active elements, like repeater elements, are needed. The gain and the transmission distance achievable by the antenna are also limited by the antenna inside the self-contained wireless transceiver so that a further disadvantage is that it is not possible to modify or adapt the gains and achievable transmission distances to specifics of the environment in which the self-contained wireless transceiver is to be used. The self-contained wireless transceiver which includes the radio signal processing circuitry and the antenna within a package or a housing has an antenna which dictates the shape and direction of the beams emitted by the antenna which does not allow for providing a desired antenna emission characteristic that is different from the original one defined by the antenna provided originally in the self-contained wireless transceiver.

To provide for a long range communication, conventional approaches are known, like in satellite communication systems, in which a receive or feed antenna is provided together with a reflector, however, there is no full integration of the wireless radio system. For example in the field of satellite communication there is a satellite LNB with the intermittent frequency interface and a separated modem for the signal processing.

Another approach is to provide dedicated high gain antenna and feeding structures instead of a reflector, as is for example described by P. Serbe et al. "Sencity™ link 60—a wireless point-to-point transparent ethernet bridge," in $8^{th}$ European Conference on Fixed Wireless Networks and Technologies, 2007.

SUMMARY

According to a first embodiment, an apparatus may have: a radio device including an antenna; and an antenna element, wherein the radio device and the antenna element are arranged such that a radio signal emitted by the antenna of the radio device is amplified in at least one predefined spatial direction, characterized in that the radio device is a fully integrated self-contained radio device including a housing or a package for housing the antenna and radio signal processing circuitry, wherein the antenna is an integrated antenna including an antenna chip, an antenna in package or an antenna board; the radio device includes an interface configured to receive a digital data signal and output a digital data signal, and a radio signal processing circuit coupled to the interface and to the antenna, wherein the radio signal processing circuit is configured to receive the digital data signal from the interface, to process the received digital data signal for generating the radio signal, and to provide the radio signal to the antenna for emitting the radio signal, and to receive the radio signal from the antenna, to process the received radio signal for generating the digital data signal, and to provide the digital data signal to the interface; the an antenna element is a passive focusing antenna; and the apparatus includes a mounting structure configured to receive the radio device at a first position and to receive the antenna element at a second position, wherein the mounting structure is configured to provide for a mechanical adjustment of the relative position between the antenna element and the radio device to steer a beam emitted by the antenna element.

According to another embodiment, a system may have: a first inventive apparatus; and a plurality of second inventive apparatus arranged at different positions distant from the first apparatus so as to allow for a point-to-mulitpoint communication or relay communication.

The present invention provides an apparatus, comprising a fully integrated self-contained radio device including an antenna, and an antenna element, wherein the radio device and the antenna element are arranged such that a radio signal emitted by the antenna of the radio device is amplified in at least one predefined spatial direction.

In accordance with embodiments the radio device and the antenna element are arranged such that the antenna element directs a radio signal received from the at least one predefined spatial direction to the antenna of the radio device.

In accordance with embodiments the radio device includes an interface configured to receive a data signal and output a data signal, and a radio signal processing circuit coupled to the interface and to the antenna, wherein the radio signal processing circuit is configured to receive the data signal from the interface, to process the received data signal for generating the radio signal, and to provide the radio signal to the antenna for emitting the radio signal, and to receive the radio signal from the antenna, to process the received radio signal for generating the data signal, and to provide the data signal to the interface.

In accordance with embodiments the radio device further includes at least one of a control signal interface configured to receive a control signal and a power supply interface configured to receive a power signal.

In accordance with embodiments the interface of the radio device is configured to receive at least one of a control signal and a power supply signal.

In accordance with embodiments the interface of the radio device comprises a serial interface configured to receive and output digital data.

In accordance with embodiments the antenna of the radio device comprises an antenna chip, an antenna in package or an antenna board.

In accordance with embodiments the antenna of the radio device emits a wide angled radio signal with an emission angle larger than the radio signal reflected by the antenna element.

In accordance with embodiments the antenna element is configured to focus energy transmitted by the antenna of the radio device towards a focus point, and to focus received energy towards the antenna of the radio device.

In accordance with embodiments the antenna element comprises a reflectarray antenna or a planar lens antenna.

In accordance with embodiments the radio device comprises a housing or a package for housing the antenna and radio signal processing circuitry.

In accordance with embodiments the apparatus comprises a mounting structure configured to receive the radio device at a first position and to receive the antenna element at a second position.

In accordance with embodiments the mounting structure is configured to provide for a mechanical adjustment of the relative position between the antenna element and the radio device to steer a beam emitted by the antenna element.

In accordance with embodiments the apparatus comprises at least one further fully integrated self-contained radio device including an antenna, wherein the radio device and the further radio device are arranged with respect to the antenna element such that radio signals emitted by the antennas of the radio devices are amplified in at least two different spatial directions.

The present invention provides a system comprising a first inventive apparatus having a mounting structure configured to receive the radio device at a first position and to receive the antenna element at a second position, wherein the mounting structure is configured to provide for a mechanical adjustment of the relative position between the antenna element and the radio device to steer a beam emitted by the antenna element, or having at least one further fully integrated self-contained radio device including an antenna, wherein the radio device and the further radio device are arranged with respect to the antenna element such that radio signals emitted by the antennas of the radio devices are amplified in at least two different spatial directions, and a plurality of second inventive apparatuses arranged at different positions distant from the first apparatus so as to allow for a point-to-mulitpoint communication or relay communication.

Thus, in accordance with the present invention, an integrated self-contained wireless transceiver which is intended for a short range communication is used in combination with a passive focusing antenna to established a long range directive communication link.

When compared to conventional approaches, more specifically to conventional integrated self-contained wireless transceivers, a massive link extension is achievable without additional active elements like repeaters or the like. It is possible to scale the apparatus to specific antenna gains and distances as desired and to provide additional antenna patterns so as to allow for desired antenna characteristics, for example fan beams. The inventive approach is advantageous as it allows for a simple mechanical construction with a substantial size and weight reduction when compared to conventional approaches, like the above mentioned satellite communication systems, as the originally highly integrated self-contained wireless transceiver is provided together with a reflector without the need for providing additional, separated communication elements. Using mass market products and mass production technologies allows reducing the costs of the apparatus. A further advantage is that no additional feeding losses occur for the large antenna aperture.

BRIEF DESCRIPTION OF THE DRAWINGS

Embodiments of the present invention will be detailed subsequently referring to the appended drawings, in which.

DETAILED DESCRIPTION OF THE INVENTION

In the following, embodiments of the present invention will be described in further detail with respect to the accompanying drawings in which elements having the same or a similar function have associated therewith the same reference signs.

Figure 1:
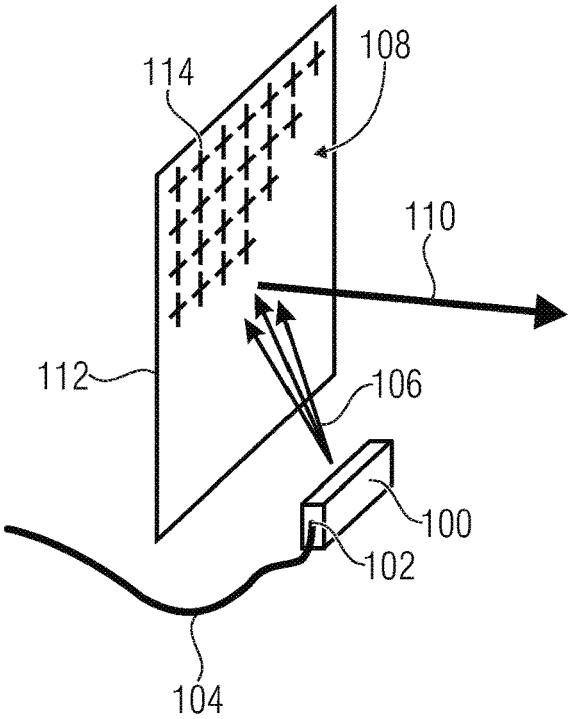
FIG. 1 is a schematic representation of the apparatus in accordance with an embodiment of the present invention.

FIG. 1 is a schematic representation of the apparatus in accordance with an embodiment of the present invention. The apparatus comprises a self-contained transceiver 100 which includes an antenna and a modem or radio signal processing circuitry. The transceiver 100, also referred to as radio device, includes an interface 102 to which an external connection line 104 is connected. The interface may be a serial digital interface for receiving a data signal, for example data bits, over the line 104. The received data signals are processed by the modem inside the transceiver 100 and are provided to the antenna transceiver 100 for emitting a wide-angled radio signal 106. The apparatus further comprises an antenna element 108 which may be a reflectarray. The transceiver 100 and the antenna element 108 are arranged in such a way that the radio signal 106 emitted by the antenna of the transceiver 100 is directed towards the antenna element 108 which is structured in such a way that a focused radio signal 110 is reflected into a desired direction. In accordance with embodiments, the transceiver 100 operates as a transmitter, whereas in other embodiments it may also operate as a receiver. When operating as a receiver, the antenna element 100 receives a radio signal and directs the received radio signal or reflects the radio signal onto the antenna of the transceiver 100. Thus, in accordance with embodiments, as is shown in FIG. 1, the fully integrated self-contained wireless transmitter and receiver (transceiver) 100 is placed in front of the focusing reflector 108 such that the transmitted energy 106 from the transceiver antenna is focused towards a remote station and that the energy coming from a remote station is focused towards the transceiver antenna.

In accordance with examples, the focusing reflector 108 is built as a passive reflectarray comprising a printed circuit board 112 on which a number of reflecting elements or patches 114 of a specific form or shape are placed. The design of the individual reflecting elements 114 causes planar radio waves coming from a certain direction to be focused towards a focus point. The size and the properties of the reflector and the patches are adapted to the transmit pattern of the transceiver antenna, the feeding antenna, and to the position of the transceiver 100 relative to the reflector 108.

Figure 2:
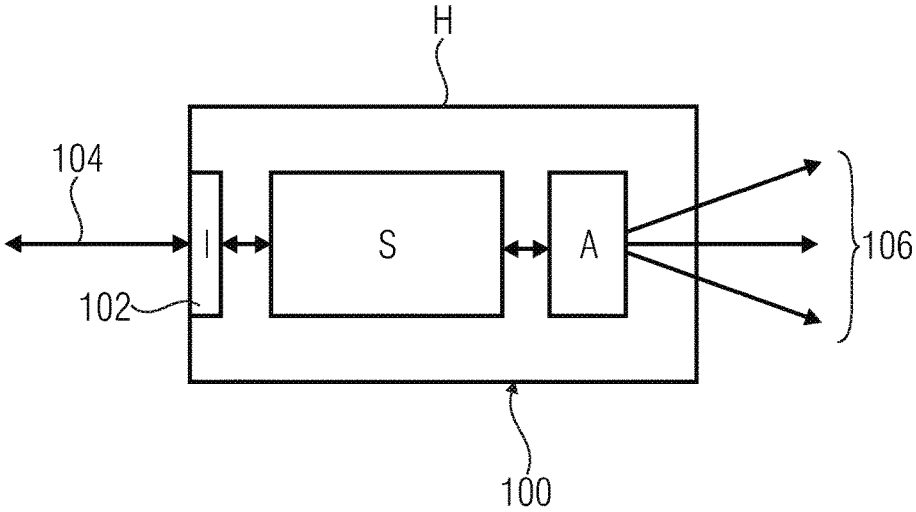
FIG. 2 is a schematic representation of an integrated self-contained wireless transceiver that may be used in accordance with embodiments of the present invention.

FIG. 2 is a schematic representation of an integrated self-contained wireless transceiver that may be used in accordance with embodiments of the present invention. The transceiver 100 includes the integrated antenna A which may be an antenna on a chip, an antenna in a package or an antenna board. The integrated antenna A emits the wide-angled radio signal 106 and receives signals. The radio device 100 further includes a radio signal processing circuit S connected or coupled between the interface 102 and the antenna A. The circuitry S receives signals via the interface 102, for example data signals, generates a radio signal for transmission and provides the radio signal for emission by the antenna A. Also, the circuitry S receives radio signals from the antenna A processes the radio signals to generate data signals output via the interface 102. The interface 102 may be a digital data interface, for example a serial interface such as an ethernet interface or a USB interface. The interface 102 may also allow for interfacing control signals and power supply signals to the transceiver 100. Alternatively, instead of embedding or integrating the control signal and power supply interfaces with the interface 102, separate interfaces, for example a separate control signal interface and a separate power supply interface may be provided.

As is schematically depicted in FIG. 2, the transceiver 100 includes a housing H or a package in which the respective elements of the transceiver 100, namely the antenna A and the circuitry S, are arranged so that the element 100 is a fully integrated self-contained wireless communication device which itself allows for a short range wireless communication as other conventional wireless communication devices. The inventive approach as described with regard to FIG. 1 allows extending the short communication range of the transceiver 100 substantially without the need for any modifications of the wireless communication device so that, for example, any conventional short range wireless transceiver can be used with the inventive approach and the communication distance can be improved by using such a conventional self-contained fully integrated transceiver together with the reflectarray, thereby allowing for the above summarized advantages with regard to the achievable communication properties.

Figure 3A:
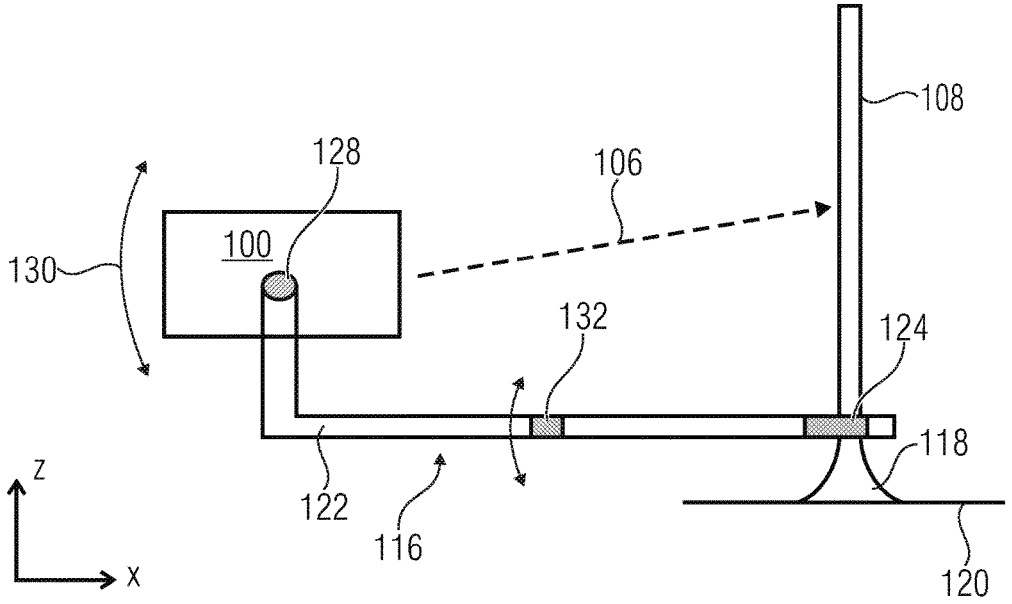
FIG. 3*a-b* shows an embodiment of the present invention depicting an example for mounting the transceiver and the antenna element with respect to each other, in which FIG. 3(*a*) depicts a side view of the structure, and FIG. 3(*b*) is a top view of the structure of FIG. 3(*a*)
Figure 3B:
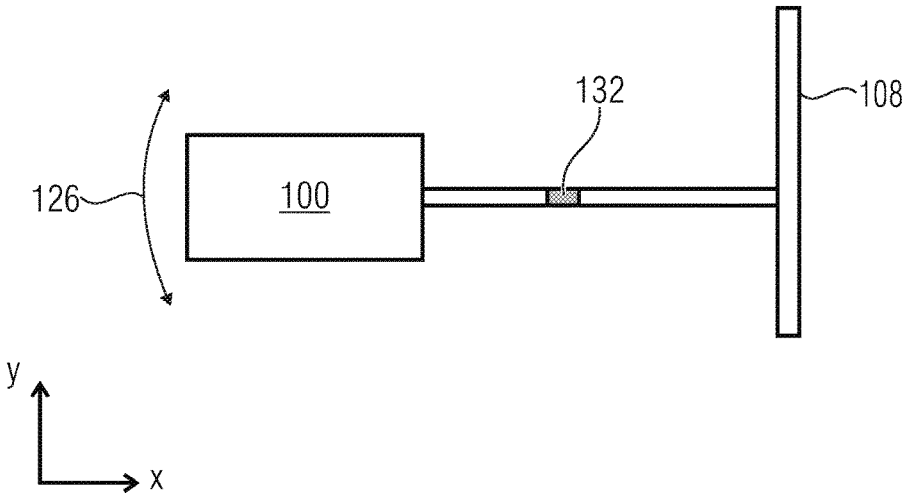

FIG. 3 shows an embodiment of the present invention depicting an example for mounting the transceiver and the antenna element 108 with respect to each other. In FIG. 3(*a*) depicts a side view of the structure, and FIG. 3(*b*) is a top view of the structure of FIG. 3(*a*). In accordance with embodiments a mounting structure 116 is provided, which comprises a base 118 resting on a floor or a mounting surface 120. The reflector element 108 may be attached to the base 118 to be stationary. The mounting structure 116 further comprises a support arm 122 having a first end mounted to the base 118 and a second end to which the transceiver 100 is mounted. The mounting structure 118 includes a first hinge or pivot point 124 so as to allow a rotation of the support arm 122 around the base 118 in the x/y-plane, as is schematically indicated by the arrow 126 in FIG. 3(*b*). Embodiments of the invention may provide a mounting structure 116 including at the second end a further hinge structure 128 for mounting the transceiver to be inclined by a desired angle with respect to the mounting surface 120, as is indicated schematically by the arrow 130 (see FIG. 3(*a*)). In addition, the support arm 122 may include an intermediate hinge 132 allowing for a vertical displacement of the transceiver 100 with respect to the base 118.

While FIG. 3 depicts a mounting structure 116 allowing for a mechanical adjustment of the transceiver position with respect to the reflectarray 108, other embodiments may provide for a mounting structure which does not allow for a mechanical adjustment but only provides for a mounting of the transceiver 100 and the reflector 108 with respect to each other in such a way that the signals from the antenna of the transceiver 100 are reflected by the reflectarray into a desired direction or such that signals received at the reflector are directed to the antenna of the transceiver 100.

Figure 4:
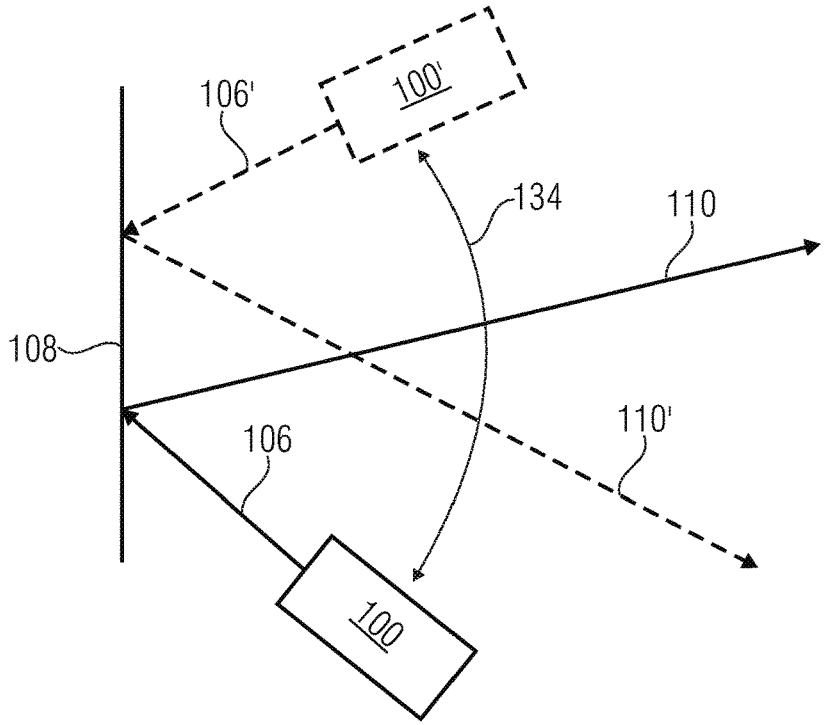
FIG. 4 shows the different positions of the transceiver when using an adjustable support as depicted with regard to FIG. 3 in accordance with an example.

Providing the possibility for a mechanical adjustment for the transceiver position is advantageous as it allows to steer the beam 110 emitted from the reflector 108 or the receive signals from different directions via the reflector 108. FIG. 4 shows the different positions of the transceiver 100 when using an adjustable support as depicted with regard to FIG. 3 in accordance with an example. In FIG. 4, the solid lines represent a first position of the transceiver 100, and the signal 106 output from the transceiver towards the reflector 108 and the reflected signal 110. The mechanical adjustment is schematically represented by the arrow 134 so that the position of the transceiver 100 changes relative to the position of the reflector 108, thereby steering the beam 110 into a different direction as is indicated by the beam 110'.

Figure 5:
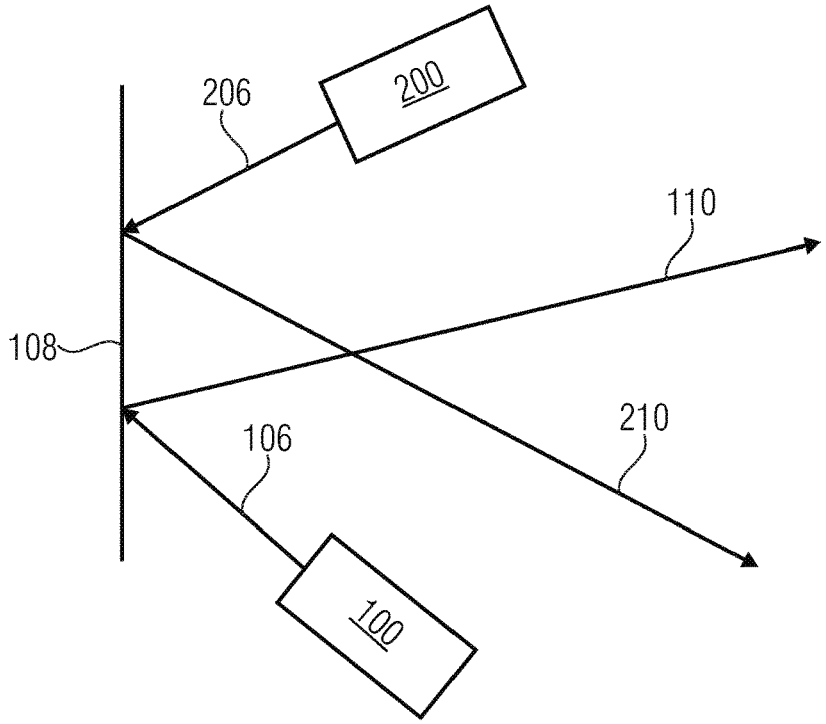
FIG. 5 shows an embodiment of the present invention including two integrated self-contained wireless transceivers arranged at different positions with respect to the reflector.

In accordance with further embodiments, two or more integrated transceivers 100 may be provided. FIG. 5 shows an embodiment of the present invention including two integrated self-contained wireless transceivers 100 and 200 arranged at different positions with respect to the reflector 108. The further transceiver 200 may have the same structure as the transceiver 100 and outputs the wide-angled radio signal 206, which is reflected by the reflector 108 as the focused signal 210. Providing two or more integrated transceivers in a way as depicted with regard to FIG. 5 allows for a transmission of signals in different reflection angles, as is shown by focused signals 110 and 210, and also allows for different focus points and a transmission with different polarizations.

Figure 6:
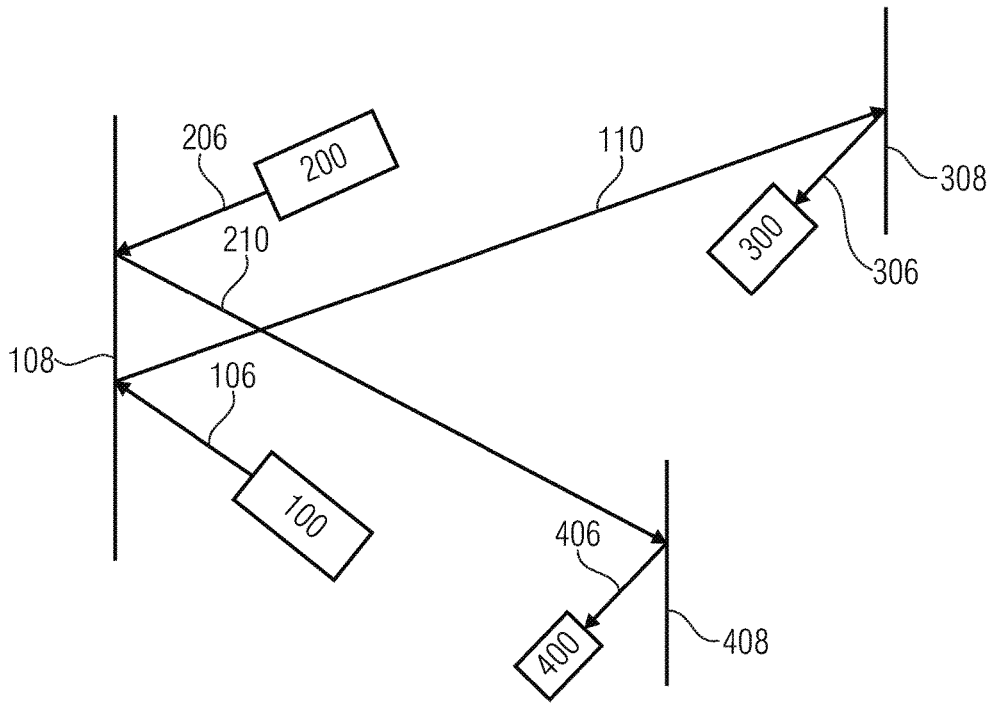
FIG. 6 shows an example of a system including three transceiver/reflector combinations as taught by the present invention.

In accordance with further embodiments, the present invention provides a system integrating multiple transceivers and reflectors so as to allow for a point-to-multipoint communication and/or a relay communication. FIG. 6 shows an example for such a system including three transceiver/reflector combinations as taught by the present invention. A first apparatus or combination may be, for example, the one as described with regard to FIG. 5 including the two transceivers 100 and 200. In an alternative embodiment, the transceiver including the mounting structure allowing for the mechanical adjustment as shown in FIG. 4 may be provided. The system includes further apparatuses including the transceiver 300 and the reflector 308 and the transceiver 400 and the reflector 408. In this structure, a communication from the first apparatus including the transceivers 100 and 200 to different points at which the receivers 300 and 400 are arranged in achieved.

The present invention has been described in the context of a reflectarray, however, other antenna elements providing for the focused signal 110 may be provided, for example a planar lens antenna or the like.

The present invention as described above with respect to different embodiments provides a combination formed of a radio part for a digital data communication with a separate antenna element such that the radio signals emitted by the integrated antenna of the radio part or radio device are amplified in respective spatial directions, wherein the radio device is fully self-contained and exchanges data via a digital, serial interface, and the antenna element may be a reflectarray or a planar lens.

Although some aspects of the described concept have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The research work that led to these results has been promoted by the European Union.

The invention claimed is:

1. An apparatus, comprising:

a radio device comprising an antenna; and an antenna element, wherein the radio device and the antenna element are arranged such that a radio signal emitted by the antenna of the radio device is amplified in at least one predefined spatial direction, wherein the radio device is a fully integrated self-contained radio device comprising a housing or a package for housing the antenna and a radio signal processing circuit, wherein the antenna is an integrated antenna comprising an antenna chip, an antenna in package or an antenna board;

wherein the radio device comprises an interface configured to receive a digital data signal and to output a digital data signal, wherein the radio signal processing circuit is coupled between the interface and to the antenna, wherein, when transmitting the radio signal, the radio signal processing circuit is configured to receive the digital data signal from the interface, to process the received digital data signal for generating the radio signal, and to provide the radio signal to the antenna for emitting the radio signal, and wherein, when receiving the radio signal, the radio signal processing circuit is configured to receive the radio signal from the antenna, to process the received radio signal for generating the digital data signal, and to provide the digital data signal to the interface;

wherein the antenna element is a passive focusing antenna; and wherein the apparatus comprises a mounting structure configured to receive the radio device at a first position and to receive the antenna element at a second position, wherein the mounting structure is configured to provide for a mechanical adjustment of the relative position between the antenna element and the radio device to steer a beam emitted by the antenna element.

2. The apparatus of claim 1, wherein the radio device and the antenna element are arranged such that the antenna element directs a radio signal received from the at least one predefined spatial direction to the antenna of the radio device.

3. The apparatus of claim 1, wherein the radio device further comprises at least one of a control signal interface configured to receive a control signal and a power supply interface configured to receive a power signal.

4. The apparatus of claim 1, wherein the interface of the radio device is configured to receive at least one of a control signal and a power supply signal.

5. The apparatus of one of claims 1 to 4, wherein the interface of the radio device comprises a serial interface.

6. The apparatus of claim 1, wherein the antenna of the radio device emits a wide angled radio signal with an emission angle larger than the radio signal reflected by the antenna element.

7. The apparatus of claim 1, wherein the antenna element is configured to focus energy transmitted by the antenna of the radio device towards a focus point, and to focus received energy towards the antenna of the radio device.

8. The apparatus of claim 1, wherein the antenna element comprises a reflectarray antenna or a planar lens antenna.

9. An apparatus, comprising:

a radio device comprising an antenna; and an antenna element, wherein the radio device and the antenna element are arranged such that a radio signal emitted by the antenna of the radio device is amplified in at least one predefined spatial direction, wherein the radio device is a fully integrated self-contained radio device comprising a housing or a package for housing the antenna and a radio signal processing circuit, wherein the antenna is an integrated antenna comprising an antenna chip, an antenna in package or an antenna board;

wherein the radio device comprises an interface configured to receive a digital data signal and to output a digital data signal, wherein the radio signal processing circuit is coupled between the interface and the antenna, wherein, when transmitting the radio signal, the radio signal processing circuit is configured to receive the digital data signal from the interface, to process the received digital data signal for generating the radio signal, and to provide the radio signal to the antenna for emitting the radio signal, and wherein, when receiving the radio signal, the radio signal processing circuit is configured to receive the radio signal from the antenna, to process the received radio signal for generating the digital data signal, and to provide the digital data signal to the interface;

wherein the antenna element is a passive focusing antenna;

wherein the apparatus comprises a mounting structure configured to receive the radio device at a first position and to receive the antenna element at a second position, wherein the mounting structure is configured to provide for a mechanical adjustment of the relative position between the antenna element and the radio device to steer a beam emitted by the antenna element; and wherein the apparatus comprises at least one further fully integrated self-contained radio device comprising an antenna, wherein the radio device and the further radio device are arranged with respect to the antenna element such that radio signals emitted by the antennas of the radio devices are amplified in at least two different spatial directions.

10. A system, comprising:

a first apparatus; and a plurality of second apparatus arranged at different positions distant from the first apparatus so as to allow for a point-to-multipoint communication or relay communication, wherein the first apparatus comprises:

a radio device comprising an antenna; and an antenna element, wherein the radio device and the antenna element are arranged such that a radio signal emitted by the antenna of the radio device is amplified in at least one predefined spatial direction, wherein the radio device is a fully integrated self-contained radio device comprising a housing or a package for housing the antenna and a radio signal processing circuit, wherein the antenna is an integrated antenna comprising an antenna chip, an antenna in package or an antenna board;

wherein the radio device comprises an interface configured to receive a digital data signal and to output a digital data signal, wherein the radio signal processing circuit is coupled between the interface and the antenna, wherein, when transmitting the radio signal, the radio signal processing circuit is configured to receive the digital data signal from the interface, to process the received digital data signal for generating the radio signal, and to provide the radio signal to the antenna for emitting the radio signal, and wherein, when receiving the radio signal, the radio signal processing circuit is configured to receive the radio signal from the antenna, to process the received radio signal for generating the digital data signal, and to provide the digital data signal to the interface;

wherein the antenna element is a passive focusing antenna;

wherein the first apparatus comprises a mounting structure configured to receive the radio device at a first position and to receive the antenna element at a second position, wherein the mounting structure is configured to provide for a mechanical adjustment of the relative position between the antenna element and the radio device to steer a beam emitted by the antenna element; and wherein the first apparatus comprises at least one further fully integrated self-contained radio device comprising an antenna, wherein the radio device and the further radio device are arranged with respect to the antenna element such that radio signals emitted by the antennas of the radio devices are amplified in at least two different spatial directions, and wherein the second apparatus comprises:

a radio device comprising an antenna; and an antenna element, wherein the radio device and the antenna element are arranged such that a radio signal emitted by the antenna of the radio device is amplified in at least one predefined spatial direction, wherein the radio device is a fully integrated self-contained radio device comprising a housing or a package for housing the antenna and a radio signal processing circuit, wherein the antenna is an integrated antenna comprising an antenna chip, an antenna in package or an antenna board;

wherein the radio device comprises an interface configured to receive a digital data signal and to output a digital data signal, wherein the radio signal processing circuit is coupled between the interface and the antenna, wherein, when transmitting the radio signal, the radio signal processing circuit is configured to receive the digital data signal from the interface, to process the received digital data signal for generating the radio signal, and to provide the radio signal to the antenna for emitting the radio signal, and wherein, when receiving the radio signal, the radio signal processing circuit is configured to receive the radio signal from the antenna, to process the received radio signal for generating the digital data signal, and to provide the digital data signal to the interface;

wherein the antenna element is a passive focusing antenna; and wherein the second apparatus comprises a mounting structure configured to receive the radio device at a first position and to receive the antenna element at a second position, wherein the mounting structure is configured to provide for a mechanical adjustment of the relative position between the antenna element and the radio device to steer a beam emitted by the antenna element.

* * * * *